US009242352B2

(12) United States Patent
Arbel et al.

(10) Patent No.: US 9,242,352 B2
(45) Date of Patent: Jan. 26, 2016

(54) ADJUSTABLE WRENCHES

(75) Inventors: Yosef Arbel, Tel-Aviv (IL); Gad Tavori, Arad (IL)

(73) Assignee: Manganon Special Products Development Ltd., Tel Aviv (IL)

( * ) Notice: Subject to any disclaimer, the term of this patent is extended or adjusted under 35 U.S.C. 154(b) by 783 days.

(21) Appl. No.: 13/133,152

(22) PCT Filed: Dec. 7, 2009

(86) PCT No.: PCT/IL2009/001153

§ 371 (c)(1), (2), (4) Date: Jun. 7, 2011

(87) PCT Pub. No.: WO2010/067356

PCT Pub. Date: Jun. 17, 2010

(65) Prior Publication Data

US 2011/0239832 A1 Oct. 6, 2011

(30) Foreign Application Priority Data

Dec. 8, 2008 (IL) ..... 195779

(51) Int. Cl.

*B25B 13/22* (2006.01)
*B25B 13/12* (2006.01)
*B25B 13/14* (2006.01)

(52) U.S. Cl.

CPC ..... *B25B 13/12* (2013.01); *B25B 13/22* (2013.01); *B25B 13/14* (2013.01)

(58) Field of Classification Search

CPC ..... B25B 13/12; B25B 13/22; B25B 13/14; B25B 13/16; B25B 13/18
USPC ..... 81/129, 134, 142, 165
See application file for complete search history.

(56) References Cited

U.S. PATENT DOCUMENTS 788,300 A * 4/1905 Wilson ..... 81/328
979,348 A * 12/1910 Smith ..... 81/129

(Continued)

FOREIGN PATENT DOCUMENTS

CN 2130654 4/1993
CN 2175068 8/1994

(Continued)

OTHER PUBLICATIONS

Communication Under Rule 71(3) EPC Dated Mar. 4, 2014 From the European Patent Office Re. Application No. 09807681.3.

(Continued)

*Primary Examiner* — Hadi Shakeri
*Assistant Examiner* — Danny Hong

(57) ABSTRACT

A wrench comprising (a) a catch, including teeth; (b) a fixed part defining a first jaw, the fixed part including two teethed parts permanently attached to the fixed part, the fixed part configured so that the two teethed parts intermesh with the teeth of the catch; (c) a moving part, defining a second jaw, such that the first jaw and the second jaw define the jaws of the wrench; and (d) a spring, whereby: (i) the two teethed parts attached to the fixed part which together serve as a guide for the moving part that is movable inside the fixed part, allowing the catch, the fixed part and the moving part to slide over one another; (ii) the catch is located in, and attached to, the moving part and selectively fixes the moving part to the fixed part; (iii) the spring pushes the catch in a direction perpendicular to the longitudinal axis of the wrench against the two teethed parts; and (iv) the fixed part serves as a gripping handle with a jaws of the wrench at its end.

17 Claims, 5 Drawing Sheets

(56) References Cited

U.S. PATENT DOCUMENTS

| | | | | | |
|---|---|---|---|---|---|
| 1,245,581 | A | * | 11/1917 | Gniewcrynski | 81/134 |
| 1,344,154 | A | * | 6/1920 | Shoopman | 81/134 |
| 1,368,089 | A | * | 2/1921 | Yguain | 81/165 |
| 1,428,546 | A | * | 9/1922 | Johnston | 81/142 |
| 2,447,685 | A | | 8/1948 | Chester | |
| 3,625,096 | A | | 12/1971 | Myers | |
| 4,151,763 | A | | 5/1979 | Colvin | |
| 4,576,529 | A | | 3/1986 | Forrer | |
| 4,915,367 | A | | 4/1990 | Carossino | |
| 5,862,722 | A | * | 1/1999 | Cislo | 81/164 |
| 6,748,826 | B2 | * | 6/2004 | Marks | 81/165 |
| 6,983,676 | B1 | | 1/2006 | Huang | |
| 2004/0074345 | A1 | * | 4/2004 | Huang | 81/142 |
| 2005/0248074 | A1 | | 11/2005 | Ray Avalani | |
| 2012/0032382 | A1 | | 2/2012 | Hendrickson et al. | |

FOREIGN PATENT DOCUMENTS

| | | |
|---|---|---|
| CN | 201015853 | 2/2008 |
| DE | 812239 | 8/1951 |
| GB | 21384 | 8/1912 |
| GB | 121967 | 12/1919 |
| WO | WO 2006/096176 | 9/2006 |
| WO | WO 2010/067356 | 6/2010 |
| WO | WO 2013/190558 | 12/2013 |

OTHER PUBLICATIONS

Communication Pursuant to Article 94(3) EPC Dated Oct. 16, 2012 From the European Patent Office Re. Application No. 09807681.3.

International Search Report and the Written Opinion Dated Jun. 14, 2010 From the International Searching Authority Re. Application No. PCT/IL2009/001153.

International Search Report and the Written Opinion Dated Oct. 10, 2013 From the International Searching Authority Re. Application No. PCT/IL2013/050531.

International Preliminary Report on Patentability Dated Dec. 31, 2014 From the International Bureau of WIPO Re. Application No. PCT/IL2013/050531.

Notification of Office Action Dated Apr. 17, 2014 From the State Intellectual Property Office of the People's Republic of China Re. Application No. 200980156162.1 and Its Translation Into English.

Notification of Office Action Dated Nov. 5, 2013 From the State Intellectual Property Office of the People's Republic of China Re. Application No. 200980156162.1 and Its Translation Into English.

Search Report Dated Nov. 5, 2013 From the State Intellectual Property Office of the People's Republic of China Re. Application No. 200980156162.1 and Its Translation Into English.

Office Action Dated Jun. 12, 2012 From the Israel Patent Office Re. Application No. 195779 and Its Translation Into English.

Office Action Dated Oct. 23, 2011 From the Israel Patent Office Re. Application No. 195779 and Its Translation Into English.

Office Action Dated Nov. 15, 2012 From the Israel Patent Office Re. Application No. 195779 and Its Translation Into English.

Translation of Notification of Office Action Dated Apr. 17, 2013 From the State Intellectual Property Office of the People's Republic of China Re. Application No. 200980156162.1.

Translation of Search Report Dated Apr. 17, 2013 From the State Intellectual Property Office of the People's Republic of China Re. Application No. 200980156162.1.

* cited by examiner

ADJUSTABLE WRENCHES

CROSS REFERENCE TO RELATED APPLICATIONS

This application is a National Phase of PCT Patent Application No. PCT/IL2009/001153 having International filing date of Dec. 7, 2009, which claims the benefit of Israel Patent Application No. 195779 filed on Dec. 8, 2008. The contents of the above applications are all incorporated herein by reference.

STATEMENT REGARDING FEDERALLY SPONSORED RESEARCH OR DEVELOPMENT

Not Applicable

THE NAMES OF PARTIES TO A JOINT RESEARCH AGREEMENT

Not Applicable

INCORPORATION BY REFERENCE OF MATERIAL SUBMITTED ON A COMPACT DISC OR AS A TEXT FILE VIA THE OFFICE ELECTRONIC FILING SYSTEM (EFS-WEB)

Not Applicable

STATEMENT REGARDING PRIOR DISCLOSURES BY THE INVENTOR OR A JOINT INVENTOR

Not Applicable

This is an invention that permits the construction of tools that are especially efficient, convenient, and economical.

The tools in this invention are adjustable wrenches, a ring wrench, an open end wrench and a pipe wrench, intended for loosening and tightening bolts having heads of various sizes, while they accurately grip the head of the bolt. The wrench is adjusted to the bolt immediately in a continuous movement.

We refer to closed and open ended wrenches for suitable bolts, in metric or inch sizes, or a combination of these, as well as a pipe wrench.

BACKGROUND OF THE INVENTION

1. Field of the Invention

A number of tools exist for which patents have been registered, and that are intended for the same purpose. None of them is identical or similar to the tools referred to above.

2. Description of Related Art Including Information Disclosed Under 37 CFR 1.97 and 1.98

Not Applicable

The closest tool is a wrench for opening bolts, for which U.S. Pat. No. 6,305,249 B1 has been registered (hereinafter. "the previous invention"). Several other patents in the field of the aforesaid tools, that are totally different from the tool referred to above, appear below.

U.S. Pat. No. 3,636,800
U.S. Pat. No. 2,437,801
U.S. Pat. No. 6,257,100
GB 688328
U.S. Pat. No. 4,967,613
U.S. Pat. No. 6,076,434
U.S. Pat. No. 336,490

Those patents do not meet the following requirements that make the wrench efficient and convenient. They require the use of both hands, the tool does not grip the bolt precisely, firmly, and rigidly, and is awkward to use.

BRIEF SUMMARY OF THE INVENTION

The present invention, in some embodiments thereof, relates to a wrench and, more particularly, but not exclusively, to an adjustable wrench.

According to an aspect of some embodiments of the present invention there is provided a wrench comprising: (a) a catch, including teeth, (b) a fixed part defining a first jaw, the fixed part including two teethed parts permanently attached to the fixed part, the fixed part configured so that the two teethed parts intermesh with the teeth of the catch, (c) a moving part, defining a second jaw, such that the first jaw and the second jaw define the jaws of the wrench, and (d) a spring, whereby: (i) the two teethed parts attached to the fixed part together serve as a guide for the moving part that is movable inside the fixed part, allowing the catch, the fixed part and the moving part to slide over one another; (ii) the catch is located in, and attached to, the moving part and selectively fixes the moving part to the fixed part; (iii) the spring pushes the catch in a direction perpendicular to the longitudinal axis of the wrench against the two teethed parts: and (iv) the fixed part serves as a gripping handle with a jaws of the wrench at its end.

According to some embodiments of the invention, the end of the moving part constitutes a moving jaw located opposite the fixed jaw of the fixed part and the catch is attached to the moving part by means of a pair of pins, by guide means or groove means and a part of the teeth of the catch protrudes from the fixed part in such a way that by pressing on it with a finger, the teeth can be moved in a direction perpendicular to the longitudinal axis of the wrench, and the catch is movable in the longitudinal direction of the wrench for closing or opening of the jaws.

According to some embodiments of the invention, the spring pushes the catch from inside the movable part perpendicular to the longitudinal axis of the wrench, in the direction of the two parts causing intermeshing of the teeth of the catch with teeth of the two parts.

According to some embodiments of the invention, when the teeth of the catch mesh with the teeth of the two parts, movement of the movable part is prevented or alternatively when the catch is pressed the teeth are released and the movable part is free to move.

According to some embodiments of the invention, the wrench is a pipe wrench and the fixed part constitutes an inclined guide, whereby the narrow side is located near the jaws of the wrench and serves as a guide for the movable part that moves inside it, the moving jaw is perpendicular to the longitudinal axis of the wrench and the gap between the movable part and the fixed part in its smallest place is minimal, so that the movable part is freely movable in the longitudinal direction of the wrench and on the broad side of the guide is a gap permitting the movable part to move perpendicular to the longitudinal axis of the wrench.

According to some embodiments of the invention, the rollers are located in a groove of the moving part, wherein the catch is located between them.

According to some embodiments of the invention, one side face of each tooth of the catch and the two parts forming an angle of substantially 90 degrees.

According to some embodiments of the invention, the other side face of each tooth of the catch and the two parts forming an angle of less than 90 degrees.

According to some embodiments of the invention, the wrench is an open ended wrench or a ring wrench, and the wrench comprises two catches, a first catch adapted for metric sizes and a second catch adapted for inch sizes.

According to an aspect of some embodiments of the present invention there is provided a tool with an adjustable gripper size, comprising: (a) a catch, (b) a fixed part including two teethed parts attached to the fixed part, and (c) a moving part, whereby the fixed part and the two teethed parts together serve as a guide for the moving part that is movable inside the fixed part; and (d) a spring; wherein the catch selectively fixes the moving part to the fixed part; and wherein the spring pushes the catch in a direction perpendicular to the longitudinal axis of the wrench against the two teethed parts.

According to some embodiments of the invention, the fixed part and the movable part define a gripping area between them at an end thereof.

According to some embodiments of the invention, the spring extends between the two teethed parts.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

The wrenches forming the subject of the current invention have a unique mechanism permitting convenient uses that do not exist in other patents. For example, they require the use of one hand only for all kinds of activities, they grip the head of the bolt totally accurately and rigidly, whether metric or inch bolts are used.

The current invention offers a wrench that requires only one hand to be used for loosening and tightening any bolt, smoothly and precisely, and without damaging the bolt itself. Adjustment to the size of the head of the bolt is done in a smooth and continuous movement, at the end of which the wrench is locked precisely on the size of the bolt.

The fact that the wrench acts on both its sides permits adjustment to a very large range of sizes of bolts.

The method of the teeth in the tool permits adjustment to bolts in metric sizes, or alternatively, to inch sizes.

DETAILED DESCRIPTION OF THE INVENTION

Figure 1:
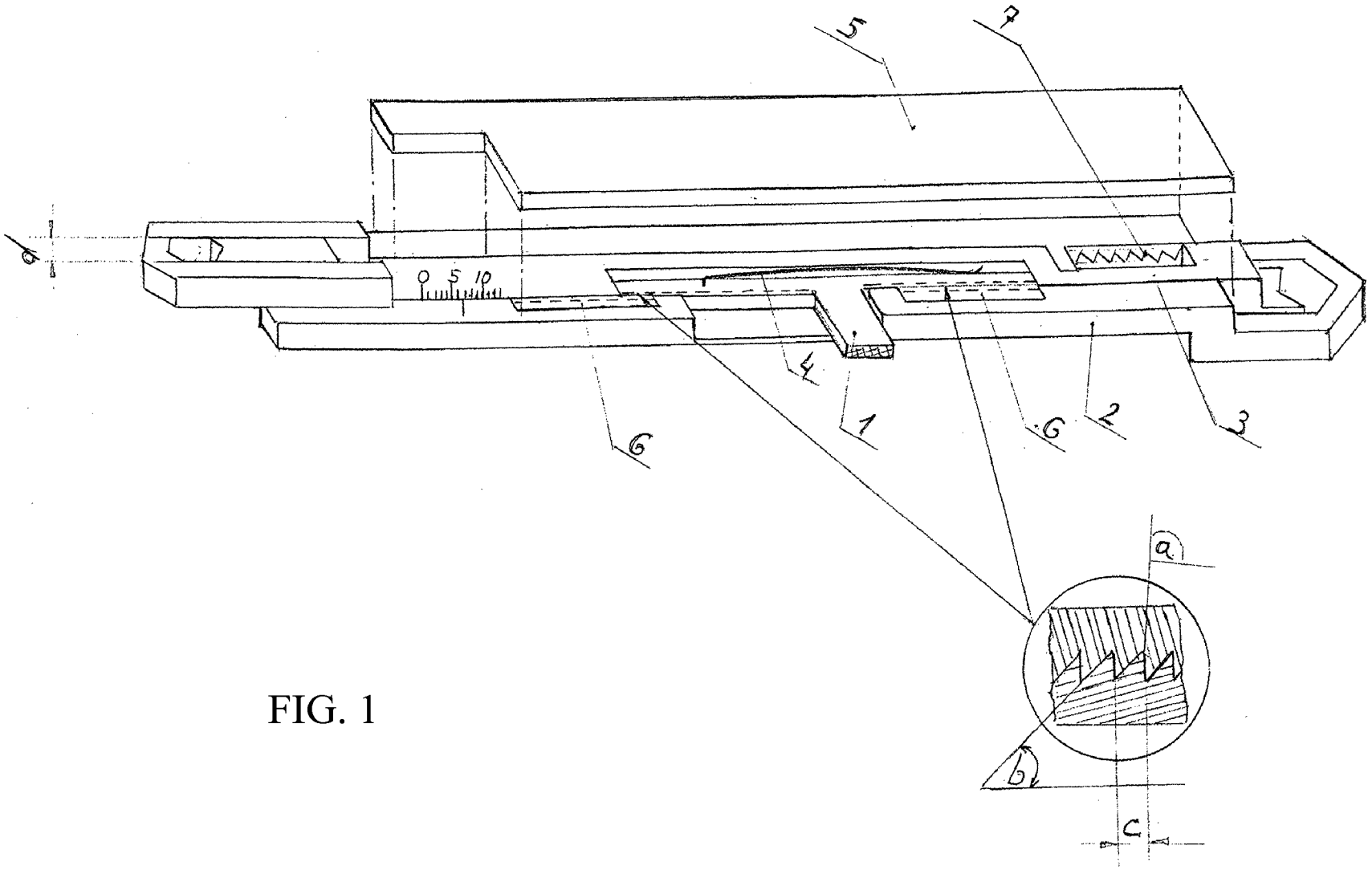
FIG. 1 is a perspective view of a wrench in accordance with a first embodiment of the invention.
Figure 2:
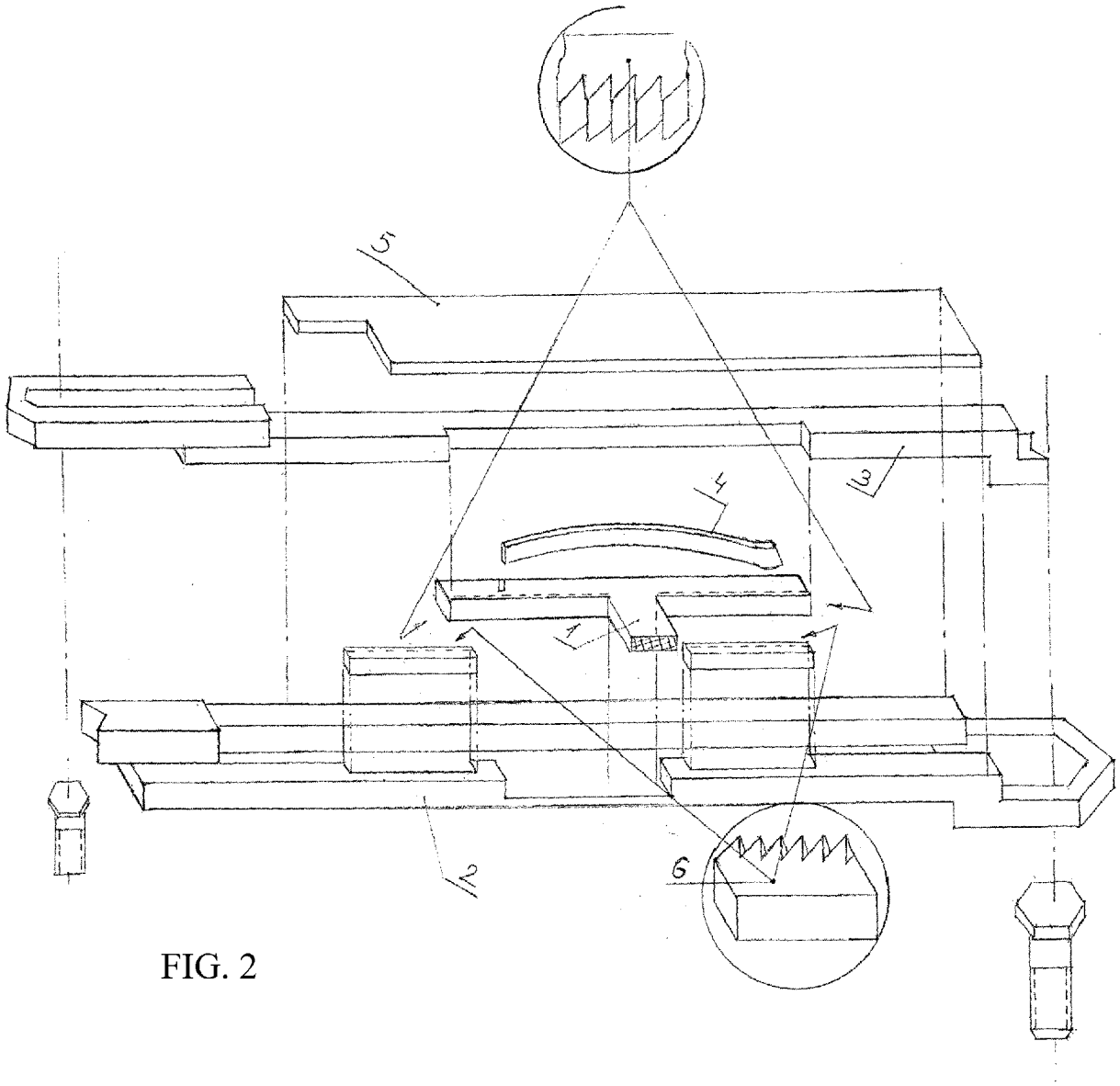
FIG. 2 is en exploded view of the wrench of FIG. 2.
Figure 3:
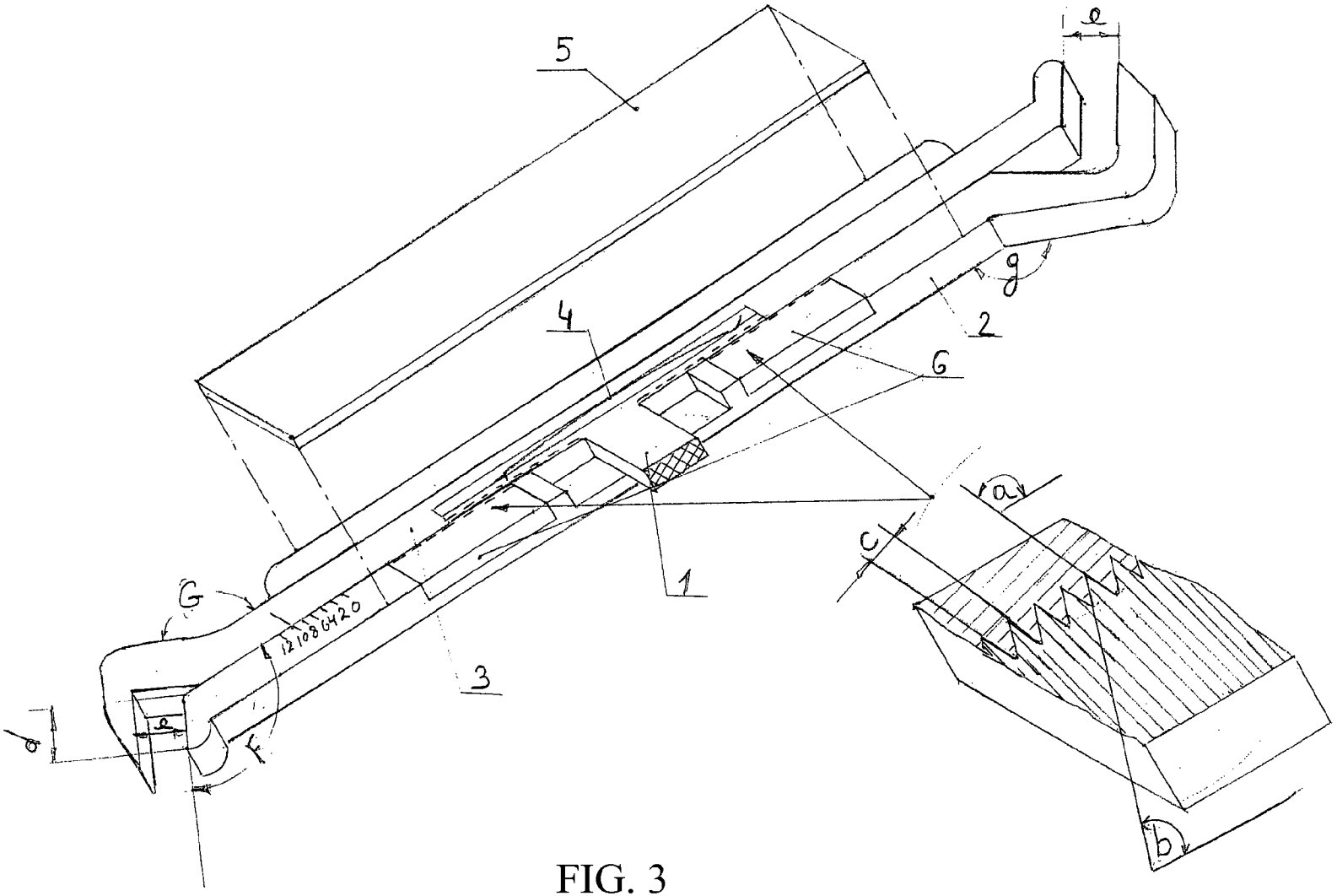
FIG. 3 is a perspective view of a wrench in accordance with a second embodiment of the invention.
Figure 4:
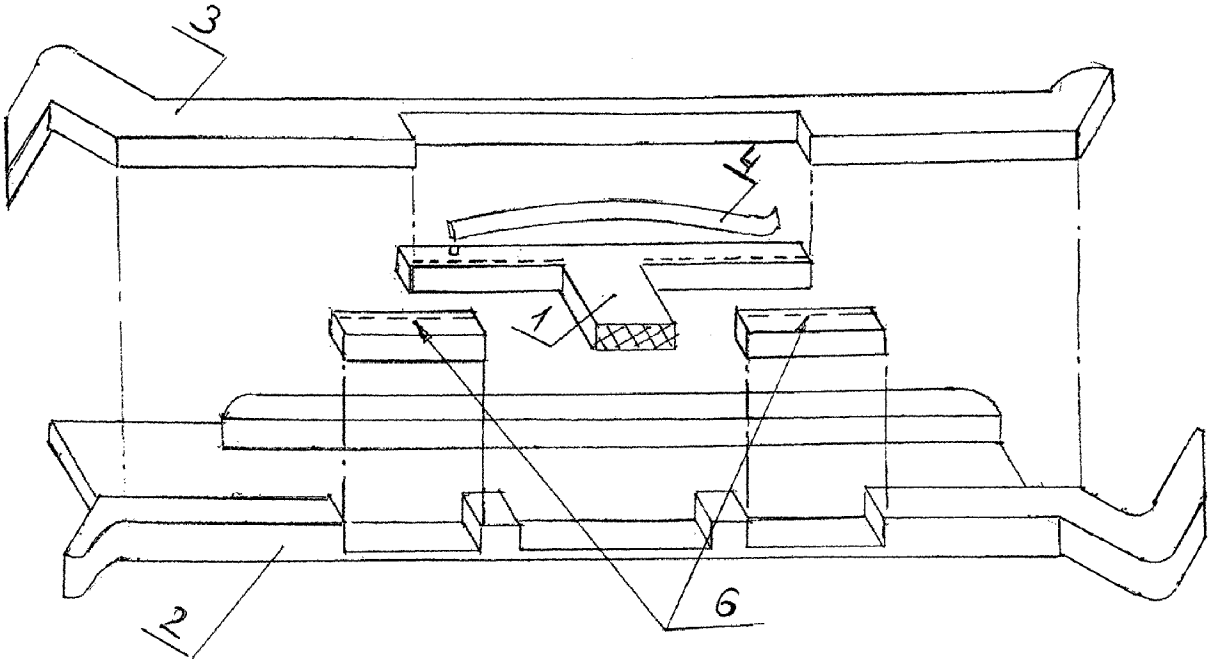
FIG. 4 is an exploded view of the wrench of FIG. 3.
Figure 5:
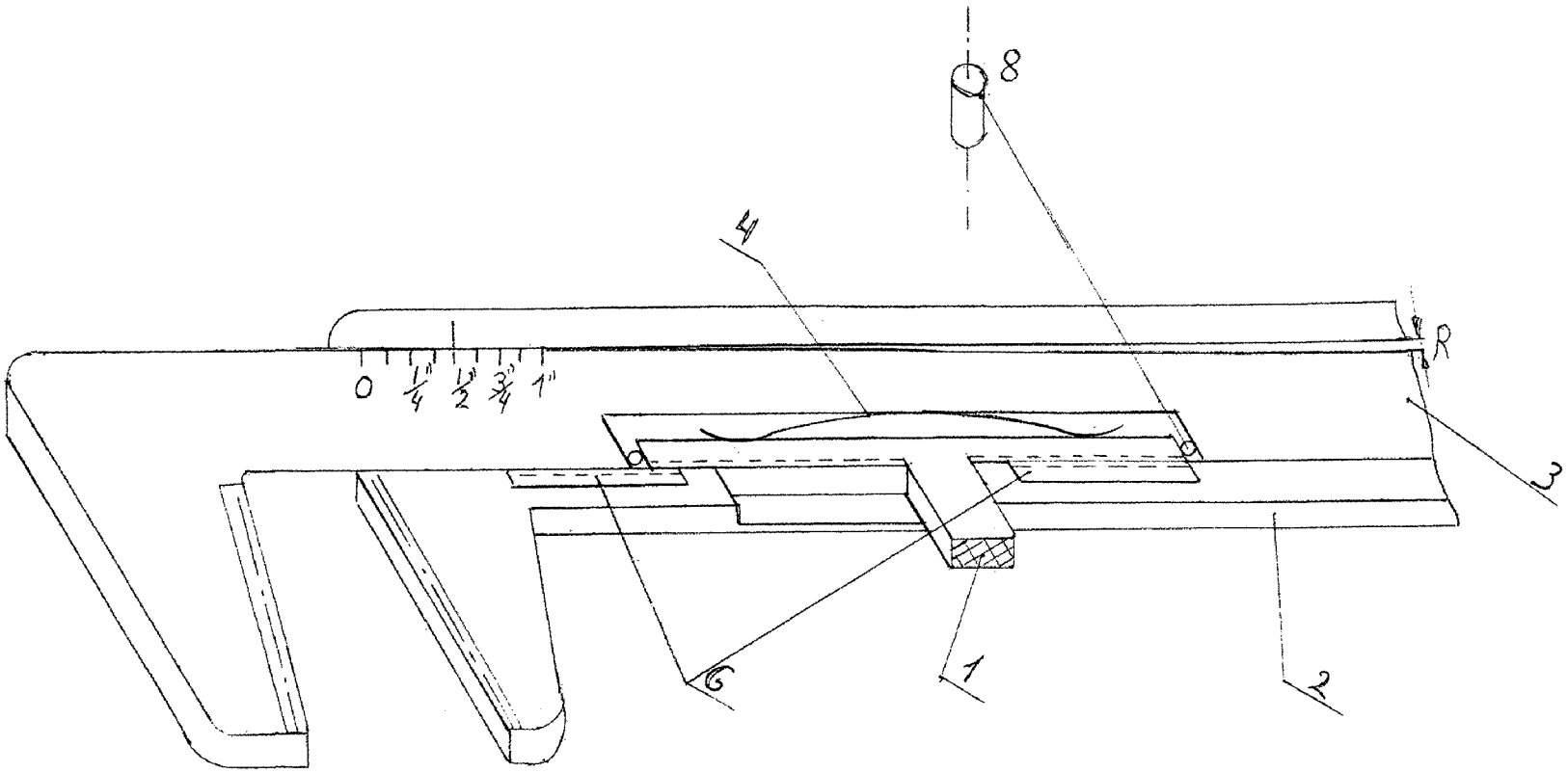
FIG. 5 is a perspective view of a wrench in accordance with a third embodiment of the invention.

The invention is an adjustable wrench. This wrench permits its user to select the size of the head of the wrench in accordance with the size of the head of the bolt (or the nut).

The wrench comprises three major parts that slide over one another.

Part No. 2 is a fixed part, part No. 3 is a moving part, and part No. 1 is the catch attached to part No. 3.

The user grips part No. 2—the fixed part, and moves part No. 3, the moving part, by means of catch No. 1, in order to open or close the wrench.

Part No. 1 is the catch pressed by a spring (part No. 4) against two parts (No. 6) permanently attached to part No. 2.

When no pressure is applied to the catch (part No. 1), the teeth of the catch and the teeth of parts No. 6 intermesh and part No. 3 is unable to move to a different size.

When the catch (part No. 1) is pressed against the spring (part No. 4), part No. 3 is free to move to the desired size.

The angle of the tooth "a" in drawing No. 3 will be 90° (measured relative to the longitudinal axis of the wrench) or close to 90°, so that when using the wrench (when applying force between parts 2 and 3 in order to increase the size of the head of the wrench) there will be no movement between parts 2 and 3.

The angle of the tooth "b", that is less than 90° as described, ensures that if a force is applied to the catch (part No. 1) in the direction of the axis of the wrench in order to close the head of the wrench, the teeth will slide and moving part No. 3 will move. The result permits reducing the size of the head of the wrench without the need to press the catch (part No. 1) against the spring (part No. 4), thus permitting convenient use of the wrench.

"C" is the pitch of the tooth.

This dimension is determined as follows: Measure the movement "H" of part No. 3 relative to part No. 2, when we move the size of the head of the wrench from a specific value to the next size.

"C" may receive different values, as follows:

$$H=n\cdot C$$

n is a natural number (1, 2, 3 . . . )

After we determine the dimension "C" using the above described method, we can determine the size of the head of the wrench precisely based on the size of the head of the bolt (or nut). The catch, the spring of the catch, and the movement of the catch are located inside a groove existing in the moving part (part No. 3), in a different way from the previous invention, where the catch, the spring and the movement of the catch are connected to the fixed part. This permits:

To grip the fixed part (No. 2) during use and easily move part No. 3 with one hand.

To locate using the same wrench, on the side opposite the existing head of the wrench, an additional head without adding parts. This permits using a head of a wrench, that is of the right size relative to the bolt or the nut.

The advantage of the this mechanism over the previous invention is that the forces between parts 2 and 3 are transferred to rigid parts (teeth and part No. 3), in contrast to the previous invention, in which the forces pass against non-rigid parts (springs).

In the previous invention most of the force is applied to the pin in a shearing motion.

With Reference to the Open Ended Wrench (Drawing No. 3)

In the open ended wrench the head of the wrench is of a special shape.

The angle "g" indicates this unique feature. This, shape permits the head of the bolt or the nut to be located near the axis of symmetry of the wrench and consequently facilitates convenience in work. In addition, the forces acting on the edges of the wrench are smaller.

The angle "F" changes the form of movement of part No. 3 against part No. 2, from horizontal to vertical motion, when applying force to loosen or tighten the bolt.

With Reference to the Pipe Wrench (Drawing No. 5)

Parts No. 8 in drawing No. 5 are two rollers whose purpose is to prevent locking between the catch, part No. 1, and part No. 3. The sides of part No. 2 inside which part No. 3 moves are inclined so that on the broad end of the wrench (the handle) there is a gap indicated by the letter "R". The letter "P" indicates the gap between part No. 2 and part No. 3, that is a minimum gap, in order to permit rotary movement of part No. 3 relative to part No. 2.

THE DIFFERENCES BETWEEN THE INVENTIONS

As stated above, the closest patent is U.S. Pat. No. 6,305,249 (hereinafter: "the previous invention"). The following are the differences between the two inventions, the advantages of the current invention and the drawbacks of the previous invention.

The Difference in the Teeth Locking the Tool on the Bolt

In the previous invention there is no reference to the shape of the teeth. The drawing indicates standard teeth with no unique features.

In the current invention the teeth are of a special shape permitting, on the one hand, the wrench to be closed to the size of the bolt in a continuous movement, and on the other hand, in the opposite direction the wrench is set and locked.

In the previous invention there is no reference to the distance between the teeth. Consequently the locking on the bolt is not precise, according to the size of the bolt, but is only approximate.

In the current invention the teeth are located at a measured distance apart, so that the gap matches the difference of the dimensions of the bolts in accordance with the formula $H=N\cdot C$, and the result is precise gripping of the bolt.

The Difference in the Teeth Catch

In the previous invention the catch is located in the fixed part of the wrench.

In the current invention the catch is located in the moving part of the wrench. This permits use to be made of the other side of the tool also, using one hand only.

In the previous invention only one side of the tool is active.

In the current invention both sides are active.

This permits twice as many sizes as in the previous invention. This permits the size of the head of the wrench to be proportional to the head of the bolt.

In the previous invention the spring holding the teeth arm absorbs a load from part No. 3 that is moving backwards, because of the shape of the teeth.

In the current invention the teeth and part No. 3 bear this load, thus fixing and locking the size of the wrench.

In the previous invention the shape of the teeth allows the size of the head of the wrench gripping the bolt to change when using the wrench.

In the current invention the teeth are locked and do not permit movement of the parts of the wrench when force is being applied. This permits greater force to be applied without causing wear to the head of the bolt.

In the previous invention the arm of the teeth moves in a circle, thus not permitting teeth of 90°.

In the current invention the teeth move in a line perpendicular to the longitudinal axis of the wrench. This permits more teeth, meaning greater strength, and also permits constructing teeth with an angle of 90°, with all the advantages entailed therein.

In the previous invention the load during tightening or loosening of the bolt is directed at the pin, and the holes holding the arm of the teeth, in a shearing motion, that considerably affects the life of the tool.

In the current invention all the load is applied to the teeth only. This prevents wear of the parts of the wrench and ensures greater strength and a longer life for the wrench.

The Difference in Structure

In the previous invention the catch is attached to the fixed part.

In the current invention the catch is attached to part No. 3.

This difference means that in the previous invention both hands are needed to cause the tool to grip the head of the bolt in a size near its size.

In the current invention only one hand is needed to adjust the wrench to the head of the bolt and its precise size.

The invention claimed is:

1. A wrench comprising:

a) a catch, including teeth, b) a fixed part defining a first jaw, said fixed part including two teethed parts permanently attached to said fixed part, said fixed part configured so that said two teethed parts intermesh with said teeth of said catch, c) a moving part, defining a second jaw, such that said first jaw and said second jaw define the jaws of the wrench, and d) a spring, whereby:

i. said two teethed parts attached to said fixed part together serve as a guide for said moving part that is movable inside the fixed part, allowing said catch, said fixed part and said moving part to slide over one another;

ii. said catch is located in, and attached to, the moving part and selectively fixes said moving part to said fixed part;

iii. said spring pushes said catch in a direction perpendicular to the longitudinal axis of said wrench against said two teethed parts; and iv. said fixed part serves as a gripping handle with a jaws of the wrench at its end.

2. A wrench according claim 1, wherein the end of the moving part constitutes a moving jaw located opposite the fixed jaw of the fixed part and the catch is attached to the moving part by means of a pair of pins, by guide means or groove means and a part of the teeth of the catch protrudes from the fixed part in such a way that by pressing on it with a finger, the teeth can be moved in a direction perpendicular to the longitudinal axis of the wrench, and the catch is movable in the longitudinal direction of the wrench for closing or opening of the jaws.

3. A wrench according to claim 2, wherein the spring pushes the catch from inside the movable part perpendicular to the longitudinal axis of the wrench, in the direction of the two parts causing intermeshing of the teeth of the catch with teeth of the two parts.

4. A wrench according to claim 3, wherein, when the teeth of the catch mesh with the teeth of the two parts, movement of the movable part is prevented or alternatively when the catch is pressed the teeth are released and the movable part is free to move.

5. A wrench according to claim 1, wherein the wrench is a pipe wrench and the fixed part constitutes an inclined guide, whereby the narrow side is located near the jaws of the wrench and serves as a guide for the movable part that moves inside it, the moving jaw is perpendicular to the longitudinal axis of the wrench and the gap between the movable part and the fixed part in its smallest place is minimal, so that the movable part is freely movable in the longitudinal direction of the wrench and on the broad side of the guide is a gap permitting the movable part to move perpendicular to the longitudinal axis of the wrench.

6. A wrench according to claim 5, wherein the rollers are located in a groove of the moving part, wherein the catch is located between them.

7. A wrench according to claim 2, wherein one side face of each tooth of the catch and the two parts forming an angle of substantially 90 degrees.

8. A wrench according to claim 6, wherein the other side face of each tooth of the catch and the two parts forming an angle of less than 90 degrees.

9. A wrench according to claim 2, wherein the wrench is an open ended wrench or a ring wrench, and wherein the wrench comprises two catches, a first catch adapted for metric sizes and a second catch adapted for inch sizes.

10. A method of adjusting a wrench according to claim 1, comprising:

pushing said catch to allow said two teethed parts to slide past each other; and releasing said catch when said wrench is correctly adjusted, so that said two teethed parts interlock.

11. A method according to claim 10, wherein said pressing is using a same hand that holds the wrench.

12. A method according to claim 10, wherein said pushing both allows said teeth to slide and causes said sliding.

13. A method according to claim 10, comprising sliding said sets of teeth past each other in a single direction when said catch is not pushed.

14. A tool with an adjustable gripper size, comprising:

a) a catch, b) a fixed part including two teethed parts attached to said fixed part, and c) a moving part, whereby the fixed part and said two teethed parts together serve as a guide for the moving part that is movable inside the fixed part; and d) a spring;

wherein the catch selectively fixes the moving part to the fixed part; and wherein said spring pushes said catch in a direction perpendicular to the longitudinal axis of said wrench against said two teethed parts.

15. A tool according to claim 14, wherein said fixed part and said movable part define a gripping area between them at an end thereof.

16. A wrench according to claim 1, wherein said spring extends between said two teethed parts.

17. A wrench according to claim 15, wherein said teeth of said catch are located at a measured distance "C" apart, wherein said measured distance between adjacent said teeth of said catch corresponds to a difference between dimensions of one of metric-sized and inch-sized bolt heads in accordance with the formula H=nC;

wherein "H" is a distance of movement of said moving part relative to said fixed part and wherein a size of said wrench gripping area is adjustable from a first value corresponding to a first-sized bolt head to a second value corresponding to a second-sized bolt head;

"n" is a natural number (1, 2, 3 . . . ); and

"C" is a distance between adjacent said teeth of said catch; and wherein, when said teeth of said two teethed parts of said fixed part intermesh with said teeth of said catch, said jaws are configured to precisely grip a bolt of one of metric size and inch size.

* * * * *